US009898955B2

(12) United States Patent
Lebrun et al.

(10) Patent No.: US 9,898,955 B2
(45) Date of Patent: Feb. 20, 2018

(54) ACTIVE-MATRIX DISPLAY WITH POWER SUPPLY VOLTAGES CONTROLLED DEPENDING ON THE TEMPERATURE

(71) Applicant: THALES, Courbevoie (FR)

(72) Inventors: Hugues Lebrun, Coublevie (FR); Thierry Kretz, Saint Jean de Moirans (FR)

(73) Assignee: Thales, Courbevoie (FR)

( * ) Notice: Subject to any disclaimer, the term of this patent is extended or adjusted under 35 U.S.C. 154(b) by 0 days.

(21) Appl. No.: 14/913,973

(22) PCT Filed: Aug. 26, 2014

(86) PCT No.: PCT/EP2014/068036

§ 371 (c)(1),
(2) Date: Feb. 23, 2016

(87) PCT Pub. No.: WO2015/028448

PCT Pub. Date: Mar. 5, 2015

(65) Prior Publication Data

US 2016/0203750 A1 Jul. 14, 2016

(30) Foreign Application Priority Data

Aug. 30, 2013 (FR) ..... 13 02015

(51) Int. Cl.
*G09G 5/10* (2006.01)
*G09G 3/20* (2006.01)
(Continued)

(52) U.S. Cl.
CPC ..... *G09G 3/2007* (2013.01); *G09G 3/3266* (2013.01); *G09G 3/3677* (2013.01);
(Continued)

(58) Field of Classification Search
CPC ..... G09G 3/36; G09G 3/2677; G09G 3/3266
(Continued)

(56) References Cited

U.S. PATENT DOCUMENTS

2007/0063959 A1* 3/2007 Iwabuchi ..... G09G 3/2074 345/100
2009/0040163 A1 2/2009 Sun
(Continued)

FOREIGN PATENT DOCUMENTS

WO 2005/073951 A1 8/2005

*Primary Examiner* — Calvin C Ma
(74) *Attorney, Agent, or Firm* — Baker Hostetetler LLP

(57) ABSTRACT

In a liquid crystal or OLED active-matrix screen, the power supply voltages VGON and VGOFF of the display control circuit driving the control transistors of the pixels are optimized, as a function of a measurement of the operating temperature, to conserve the display qualities of the screen at high and low temperatures and reduce the power consumed on average to produce screens for applications in a severe environment, with transistors of standard size. Circuits are provided for supplying these analog voltages from numeric values supplied by a code associated with the temperature measurement, stored or computed by a programmable circuit. Provision is made to adapt these voltages as a function of a measurement of lighting level received by the transistors of the display control circuit. The optimization extends to the power supply and reference voltages necessary to the control of the pixels, notably to the gamma reference voltages.

8 Claims, 3 Drawing Sheets

(51) Int. Cl.
*G09G 3/3266* (2016.01)
*G09G 3/36* (2006.01)

(52) U.S. Cl.
CPC ..... *G09G 2320/0219* (2013.01); *G09G 2320/0276* (2013.01); *G09G 2320/041* (2013.01); *G09G 2320/0673* (2013.01); *G09G 2330/021* (2013.01); *G09G 2360/144* (2013.01); *G09G 2380/12* (2013.01)

(58) Field of Classification Search
USPC ..... 345/100, 211, 690
See application file for complete search history.

(56) References Cited

U.S. PATENT DOCUMENTS

2011/0205212 A1* 8/2011 Matsumoto ..... G09G 3/3677 345/211
2012/0139955 A1* 6/2012 Jaffari ..... G06F 17/5018 345/690

* cited by examiner

ACTIVE-MATRIX DISPLAY WITH POWER SUPPLY VOLTAGES CONTROLLED DEPENDING ON THE TEMPERATURE

CROSS-REFERENCE TO RELATED APPLICATIONS

This application is a National Stage of International patent application PCT/EP2014/068036, filed on Aug. 26, 2014, which claims priority to foreign French patent application No. FR 1302015, filed on Aug. 30, 2013, the disclosures of which are incorporated by reference in their entirety.

FIELD OF THE INVENTION

Technical Field

The invention relates to active-matrix screens with field-effect transistors in thin films. It applies notably to the liquid crystal screens (LCD screens) and to the organic light-emitting diode screens (OLED or AMOLED screens).

BACKGROUND

An active-matrix screen should be understood to be a screen in which a circuit with transistors and storage capacitor(s) is associated with each pixel of the matrix, enabling a display control circuit, also transistor-based, to individually drive each pixel. This display control circuit which in reality comprises a plurality of circuits for addressing the rows, columns and common electrode of the matrix, is a circuit that is generally integrated on the same substrate at the periphery of the active-matrix zone.

The transistors employed in these screens are field-effect transistors, in so-called thin-film technology, based on amorphous silicon. The conduction characteristics of these transistors can change significantly according to the working operating conditions.

In particular, the mobility of the charge carriers in the amorphous silicon varies with the temperature: with current technologies, it thus changes from 0.1 $cm^2/V/s$ at −40° C. to 0.75 $cm^2/V/s$ at 70° C. Also, the leakage current of the transistors tends to increase with the light received by these transistors. Such is notably the case in the liquid crystal screens, according to the level of the lighting supplied by the liquid crystal backlighting source: this intensity indeed varies according to the ambient brightness conditions (day or night ambience).

For some applications, notably in the transport field (avionics, motor vehicles, maritime), the screens need to be able to work in highly variable conditions, without notable degradation of the display quality. In particular, they have to be operational over a wide temperature range, which can extend from minus 40 to plus 70 degrees Celsius for example for applications in the avionics field.

These variable and severe operating conditions are reflected in variations of the conduction parameters of the transistors. For example, after a long period of operation at high temperature, a few hundreds of hours, the threshold voltage of the transistors is temporarily increased. If it is assumed that the temperature then drops, the mobility of the carriers drops also, but the threshold voltage of the transistors at that moment is still high because of the previous high-temperature episode.

Also, to be able to control these transistors reliably, in the on state and in the off state, regardless of the immediate conduction conditions of the transistors, transistors are used which are defined with a geometry (ratio of the width to the length of the transistor channel) greater than that normally necessary. The transistors are said to be overdimensioned.

This overdimensioning of the transistors necessitates the use of equally greater values for the associated coupling and compensation capacitors and of higher power supply voltages for controlling these elements. Thus, in the avionics field, the power supply voltage is of the order of +33 volts and the maximum voltage amplitude for controlling the pixel capacitor is of the same order.

This overdimensioning of the components presents a number of drawbacks.

With respect to the aspects affecting manufacture, the overdimensioning is reflected in an increased surface area; hence a greater bulk of the driver circuits at the periphery of the panel; also, there is a greater risk of manufacturing defect commensurate with this increased surface area.

With respect to working operation, there is a true difficulty in stabilizing the output state of these driver circuits throughout the temperature range. In practice, these outputs oscillate when temperature rises. This is explained by the greater leakage currents; high current demands necessary to charge the higher capacitors, in sufficiently short times; a rapid drift of the threshold voltages because of the high voltage applied.

These oscillations can lead to perceptible flickers on the image displayed, which damage the "cosmetic" quality of the display.

It is known practice to reduce these oscillations by deliberately degrading, in manufacture, the threshold voltages of the transistors. However, how to do so in a perfectly controlled manner is not known. Furthermore, these degradation techniques reduce the life of the transistors, therefore of the screens.

Finally, these screens consume more because of the power supply and control voltage levels used.

SUMMARY OF THE INVENTION

The subject of the invention is an alternative technique making it possible to propose active-matrix screens that perform over wide temperature ranges, at lower cost and with lower power consumption.

One idea on which the invention is based is to retain transistors of standard size, but adapt, as a function of the temperature, the power supply voltages which control these transistors, more particularly the transistors of the pixel row selection circuits.

By increasing these voltages for low temperatures, the most unfavorable transistor conduction conditions are compensated; by lowering these voltages for the high temperatures, conduction conditions that are on the contrary more favorable can be taken advantage of and the threshold voltage drift, which depends greatly on the gate voltage value of the transistor, is reduced. In all cases, the leakage currents are minimized, therefore optimized. Overall, by this adaptation of the voltages as a function of the temperature, the power consumed by a screen is also advantageously reduced.

The invention therefore relates to a display screen comprising an active matrix of pixels arranged in rows and columns, the active matrix comprising a control transistor associated with each pixel, the screen comprising a display control circuit supplying signals driving the control transistors of the pixels, characterized in that the screen comprises:

means for supplying a temperature measurement, a programmable circuit supplying as output a numeric code associated with the temperature measurement and a circuit supplying a first voltage and a second voltage powering the display control circuit making it possible to apply, respectively, a switch-on voltage and a switch-off voltage to the control transistors of the pixels, the circuit receiving the numeric code and supplying the first and second voltages as a function of numeric values of the code.

When the temperature drops, the numeric code defined leads to an increase in the first and the second analog voltages, and also an increase in their difference.

When the temperature rises, the numeric code defined leads to a decrease in the first and the second analog voltages, and also a decrease in their difference.

The numeric code can comprise numeric values setting the gamma reference voltages which define at least one gray scale.

In the various implementations proposed, the programmable circuit can be implemented by a memory circuit which contains a plurality of codes, each defined for a given temperature band.

It is also possible to provide for the code to be computed by the programmable circuit, for the measured temperature, according to a predetermined computation function.

In a variant, provision can advantageously be made for the codes to be defined or computed as a function of the temperature, but also as a function of a lighting level received by the control transistors.

BRIEF DESCRIPTION OF THE DRAWINGS

Other features and advantages of the invention are presented in the following detailed description, and in the attached drawings in which.

DETAILED DESCRIPTION

The invention will be explained in an exemplary application to an active-matrix, liquid crystal (LCD) display screen.

Figure 1:
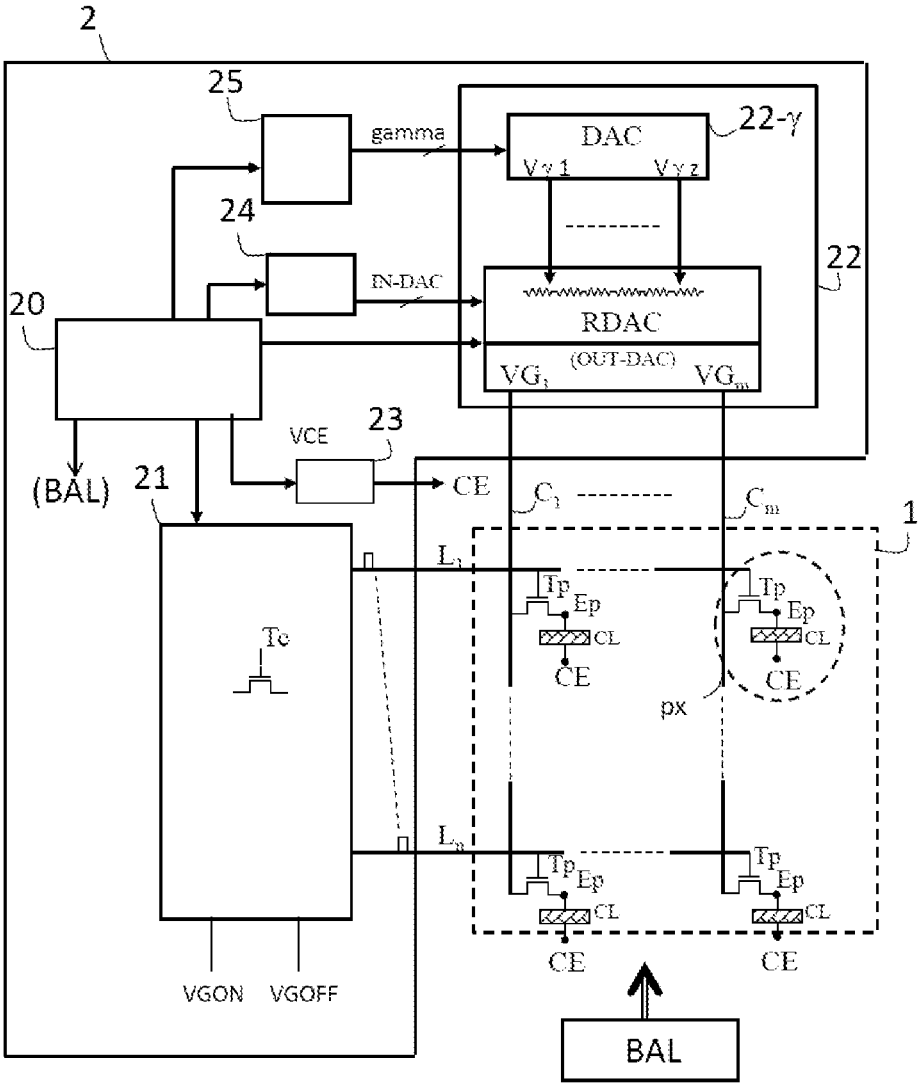
FIG. 1 is a block diagram of an active matrix of liquid crystal pixels and its peripheral display control circuit according to the prior art.
Figure 2:
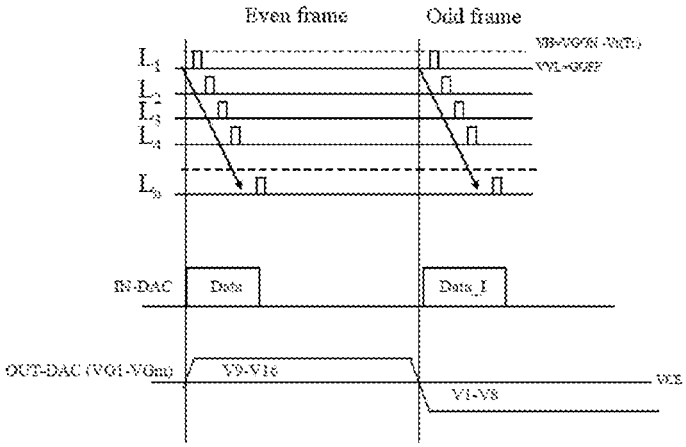
FIG. 2 is a timing diagram representing the selection and data signals, in an addressing mode with scanning of the rows and in frame inversion mode.
Figure 3:
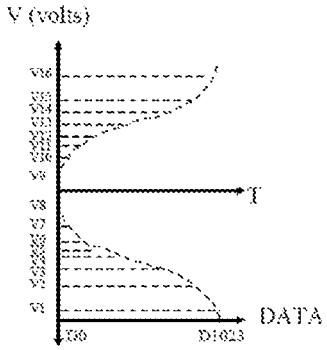
FIG. 3 illustrates an exemplary response of a circuit supplying analog voltages applied to the columns as a function of the data coding the gray levels to be displayed.

FIG. 1 schematically illustrates the main elements of such an LCD display screen and FIGS. 2 and 3 review the principles of addressing of the pixels and of gray level display control.

The screen comprises an active matrix 1 of pixels px. Each pixel is associated with a control transistor Tp and comprises a liquid crystal between an electrode Ep specific to the pixel and a counter-electrode CE common to a pixel, a group of pixels, or to all the pixels. The screen also comprises a display control circuit 2 which drives the transistors Tp of the pixels and the counter-electrode, making it possible to control the pixel voltage Vpx applied between the terminals Ep and CE of the pixel capacitor in each display frame; and a light box BAL supplying the backlighting light for the liquid crystal.

The matrix of pixels comprises n rows $L_1$ to $L_n$ each comprising m pixels and m columns $C_1$ to $C_m$ each comprising n pixels. The gate electrodes of the transistors Tp in a same row of pixels are linked in common to the row conductor $L_1, \ldots L_m$ and the source or drain conducting electrodes of the transistors Tp in a same column of pixels are linked in common to the column conductor $C_1, \ldots C_m$, the other electrode being linked to a pixel electrode Ep of the associated pixel px. The counter-electrode of the pixel receives a bias voltage VCE.

The display of a gray level on a pixel of the matrix comprises: a pixel row Li selection time, with the application of a voltage to the row Li conductor controlling the switching on of the transistor Tp of each of the pixels of the row and of a column voltage VGj to the column conductor Cj corresponding to the gray level to be displayed by the pixel; a time to establish the pixel voltage at the terminals of the pixel capacitor; a display time during which the light box lights the liquid crystal which allows more or less light to pass depending on the pixel voltage level at its terminals (absolute value of the difference VGj minus VCE).

This display is controlled by the display control circuit 2 which notably comprises a sequencing circuit 20 ensuring the synchronized operation of a circuit 21 for addressing the rows $L_1$-$L_n$, of a circuit 22 controlling the voltages on the columns $C_1$-$C_m$ and of a circuit 23 controlling the counter-electrode CE. The sequencing circuit makes it possible to control, at a frame frequency, the display of an image from digital data stored in a buffer memory 24.

There are a number of pixel addressing and sequencing modes. A choice was made to present a fairly standard addressing and sequencing mode in relation to FIGS. 1 to 3 in order to then explain the adaptation of the power supply voltages according to the invention in the duly posited context. A person skilled in the art will be able to adapt or extrapolate as required the information given hereinbelow to apply the invention to other modes.

The row addressing circuit 21 is usually a shift register with as many output stages as there are rows $L_1$-$L_n$ of the matrix to be controlled. The output stages comprise voltage switching transistors Tc. These circuits are widely known and described in the technical literature.

The column control circuit 22 mainly comprises a converter for supplying, for each new row $L_1$ selected, the column voltages $VG_1$-$VG_m$ to be applied to the columns $C_1$-$C_m$, as a function of data Data, Data_I (FIG. 3) coding the gray levels supplied by the buffer memory 24. The circuit 22 comprises the circuits needed (not represented) to power, with these data, the input IN-DAC of the converter at the row frequency and transfer the voltages $VG_1$-$VG_m$ at the output OUT-DAC of the converter, to the columns.

As illustrated in FIG. 1, the conversion incorporates, as is well known, a correction called gamma correction which corrects the non-linearity of the electro-optical response of the pixels. It should be noted that this correction is not specific to the liquid crystal screens. It is valid also for the OLED screens. A conventional correction method uses a network of resistors and gamma reference analog voltages Vγ1-Vγz applied appropriately to the nodes of this network. In this case, the converter is said to be an R-DAC converter. The gamma reference voltages are defined for each screen, as a function of the specific characteristics of the screen and thus define a scale of z gray levels ranging from white to black. If the screen is a color screen, with colored filters, or without filter but with a light box capable of successively lighting the screen in different colors, different gamma corrections are generally applied for each color. Also, the gamma reference voltages Vγ1-Vγz are themselves usually supplied by a circuit 22-γ with digital-analog converter, on the basis of numeric values defined for the screen and, as appropriate, for each color, defining one or more gray scales, stored in a programmable memory circuit 25 (FIG. 1).

As schematically illustrated in FIG. 2, the addressing circuit 21 makes it possible, on each new frame, to select the rows each one after the other (sequential scanning of the rows). Throughout the row selection time, the column control circuit supplies the columns with the corresponding voltages VG1-VGm, to control the gray levels to be applied to the pixels of the row selected, from the buffer memory data.

With respect to liquid crystal screens, it also has to be indicated that it is necessary to periodically invert the bias of the voltage applied to the terminals of the liquid crystal, to prevent the marking of the screens. There are various inversion mode implementations and techniques that are well known: frame inversion, row inversion, column inversion, or point inversion. In the example represented with reference to FIG. 2, a frame inversion mode is shown: for the even frames, a positive bias is applied, and for the odd frames, a negative bias is applied. This bias inversion can be obtained according to different techniques that are well known. In the example illustrated with reference to FIGS. 1 to 3, this is obtained by applying numeric data, respectively positive denoted Data, and negative denoted Data_I, by using an additional coding bit, and the RDAC converter supplies the corresponding column voltages, with integrated gamma correction, VG1 to VG8 for the odd frames and VG9 to VG16 for the even frames. Typically, VG1 and VG16 are respectively −6 and +6 volts. In this implementation, the counter-electrode voltage level VCE is continuous, and corresponds substantially to the midpoint between the two ranges VG1-VG8 and VG9 to VG16 as illustrated in FIGS. 2 and 3.

In this addressing mode, on each new display frame, a row conductor receives, from the row addressing circuit 22, a select pulse for a time called row select time, such that:

during this row select time, the row conductor receives a switch-on voltage VH for the transistors Tp of the row, and outside of this row select time, it receives a voltage VL which makes it possible to switch off the transistors Tp of the row.

The switch-on voltage VH for the pixel transistors Tp corresponds, to within the threshold voltage of a control transistor Tc, to a first power supply voltage VGON of the circuit 22, corresponding to a positive voltage.

The switch-off voltage VL for the pixel transistors Tp corresponds substantially to a second power supply voltage VGOFF of the circuit 22, negative or zero.

On each frame, the row addressing circuit 21 (shift register with n stages), successively addresses, at a row frequency, the rows of the matrix. During the addressing (the selection) of a row, the column control circuit 22 receives the information Data or Data_I to be displayed on the pixels of the row selected at the input IN-DAC of the converter R-DAC which establishes, at the output OUTDAC, for the gamma reference voltages Vγ1-Vγz supplied, the analog voltages VG1-VGm which are to be applied to the column conductors $C_1 \ldots C_m$. In this exemplary implementation, it has been seen that the counter-electrode bias voltage VCE is continuous. Its level is set to take account of a voltage offset. This offset is that induced by the capacitive coupling which exists de facto between each pixel and its associated row, at the moment of the deselection of this row. To have an absolute voltage value at the terminals of the pixel capacitor, identical over the even and odd frames, for a same gray level, the counter-electrode voltage is shifted by the value of the offset, ensuring an overall compensation over all the pixels. Since the value of the offset is variable as a function of the gray level (that is to say as a function of the voltage applied to the column at the moment of deselection), a second offset compensation level is incorporated in the definition of the gamma voltage reference voltages, which establishes the gray level scale.

With these recaps being given with regard to the control of an active-matrix LCD screen, the invention consists primarily in setting, as a function of a temperature measurement, the power supply voltages VGON and VGOFF and their difference VGON−VGOFF, for an optimized control of the transistors Tc used in high-impedance switching in the circuit 21 to supply, to a respective row of the matrix, the row select signal as illustrated in FIG. 2, with the high voltage level VH=VGON−Vtp during a selection time and a low voltage level VL=VGOFF otherwise, and of the pixel control transistors Tp, to make it possible, during the row select time, to optimally charge the pixel capacitor to the column voltage level corresponding to the gray level to be displayed and maintain it without losses (minimized leakage currents).

This adaptation is more specifically performed as follows:

At the lowest temperatures, to counter a degradation of the conduction of the transistors, by application of higher VGON and VGOFF voltages, and of a difference VGON−VGOFF (applied between the gate electrode and a drain or source electrode of the transistors Tc, to switch the VGON level) that is also higher: more unfavorable transistor conduction conditions (reduced mobility therefore less current with equal bias) are thus compensated. The reduction of the leakage current of the transistors is exploited to raise the voltage VGOFF relative to the column voltage: at low temperature, it is not necessary to very negatively bias the gate of the pixel transistors (Tp) to obtain a low leakage current. This compensation operates all the better as, at low temperature, the drift in the performance levels (threshold voltage) of the transistors is low, such that higher power supply voltages are well supported.

At the highest temperatures, to profit from conduction conditions that are on the contrary more favorable, by application of lower power supply voltages VGON and VGOFF and a difference VGON−VGOFF that is also lower, without in any way promoting the performance degradation process: the threshold voltage drifts more slowly with these lower levels. Furthermore, the leakage current also becomes lower if the voltage VGOFF is lowered, such that the impact of the light on these leakage currents becomes negligible. Finally, because of lower voltages, the effects of instability of the control circuits are also limited or nonexistent.

In all cases, the leakage currents are minimized. Overall, by this adaptation of the voltages as a function of the temperature measurement, the power consumed by a screen is also advantageously reduced, notably at high temperature.

Take a practical example. Assume that the voltage applied to the columns varies between 0 and ±6 volts (FIG. 3), and the DC power supply voltage of the screen is VDD=33 volts.

According to the prior art, the VGON and VGOFF levels and their level difference VGON−VGOFF are set to:

switch with the least possible loss the VGON level on the selection rows regardless of the temperature;

optimize VGON to favor the conduction of the control transistors Tp of the pixels selected at low temperatures;

optimize VGOFF to ensure the switching off, by minimizing the leakage current of the transistors Tp, at high temperatures.

In practice, VGOFF=−11 volts and VGON=22 volts are chosen for an amplitude VGON−VGOFF=33 volts (VDD).

According to the invention, by considering only two opposing temperature bands:

At low temperatures, VGOFF=−9 volts and VGON=24 volts are applied for an amplitude VGON−VGOFF=33 volts (VDD). By doing this, the conduction is favored, the leakage current of the transistors being naturally low.

At high temperatures, VGOFF=−11 volts and VGON=11 volts are applied for an amplitude VGON−VGOFF=22 volts (VDD). Here, the good conduction is exploited to lower the positive voltage amplitude and level and the leakage currents are minimized by a more negative voltage VGOFF. The consumption is also lowered.

With this adaptation, it is then possible to use transistors with standard geometry, that is to say no different from that of the transistors used in screens intended for applications in more conventional environments.

Figure 4:
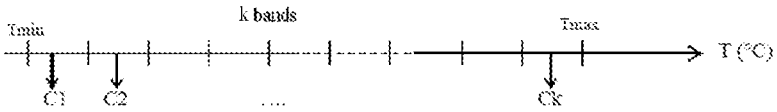
FIG. 4 illustrates the principle of the invention according to which each temperature band of an operational temperature range is assigned a code which defines one or more power supply voltages for the display control circuit of an active-matrix screen.
Figure 5:
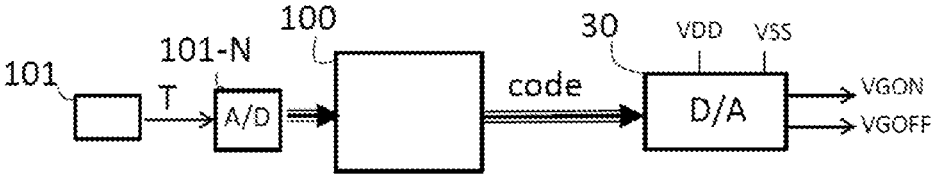
FIG. 5 is a block diagram illustrating the adaptation of the power supply voltages of the transistors of the display control circuit according to the invention.

As schematically represented in FIG. 4, a practical implementation of the invention thus comprises the division of the operational temperature range [Tmin-Tmax] of the screen into k temperature bands. For each band, a numeric code C1, C2, . . . Ck defining the power supply voltage or voltages is determined. In a preferred embodiment, the bands are of equal extent. For example, the −40° C.+70° C. range can be divided into k=22 bands of 5° extent and, for each of these bands, an associated numeric code can be determined that defines the power supply voltages VGON and VGOFF suited to the conduction characteristics of the transistors in this band. For a given screen (technology/topology), these characteristics can be measured on leaving production or can be determined by computation functions.

In a practical embodiment (FIG. 4), these codes are determined and stored in a programmable memory circuit, typically a memory of EEPROM (electrically erasable and programmable) type. The temperature measurement serves as a pointer to this memory making it possible to select the corresponding code which provides the numeric values to be applied to a circuit 30 supplying the power supplied to voltages. More specifically, the temperature measurement is converted into a numeric value, and a threshold comparator supplies, as output, a value which corresponds to the corresponding temperature band. This value serves as an address pointer to the corresponding code contained in the memory.

In another embodiment, the code is computed for the temperature measurement, by a programmable circuit, from computation functions defined for the screen concerned.

The temperature measurement T is made by a temperature sensor 101 and supplied in numeric form by an associated converter 101-N. The sensor is, in practice, an electrical sensor, metal or semiconductor-based, incorporated in proximity to the display control circuit 2, for the measurement supplied to reliably represent the temperature to which the transistors are subjected. This measurement has a corresponding code supplied by a programmable circuit 100: either it is stored in this circuit 100 and the measurement makes it possible to point to a memory address (for example via a threshold comparator, which makes it possible to determine the rank of the corresponding temperature band out of the k temperature bands of FIG. 4); or it is computed by the circuit 100, from the temperature measurement.

In practice, it has been seen that, in each temperature band, a value for VGON and a value for VGOFF are preferably defined: the code will for example be able to contain a series of two coded numeric values, one for each voltage, applied to a respective analog voltage generation circuit (with digital-analog converters and amplifiers) which supplies the voltages VGON and VGOFF. For example, the values are coded on 10 bits.

In a refinement which takes into account the gamma correction aspects contributing to the cosmetic quality of the display, provision is made to also define, for each of the k temperature bands, not only the power supply voltages VGON and VGOFF, but also the gamma reference voltages defining a gray scale. If a number of gray scales are provided for the control of the screen, for example as a function of the color to be displayed on a pixel, the code defines the gamma voltage references of the different gray scales.

More generally, provision is made for the code to define the different power supply or reference voltages used for the control of the display.

To return to the example of a liquid crystal screen and of an addressing mode as described in relation to FIGS. 1 to 3, provision is made for the numeric code to define the voltages VGON and VGOFF, the gamma reference voltages, and the counter-electrode bias voltage for each temperature band. In this way, the control and the quality of the display are optimized as a function of the temperature.

In particular, it has been seen that the offset induced by capacitive coupling at the moment of the row deselection is a function of the difference VGON−VGOFF. If VGON−VGOFF is modified, it is thus preferable, in order to retain a good compensation and therefore the quality of the display, to modify the setting of the counter-electrode bias voltage VCE. It is then necessary to also adapt the set of gamma reference voltages, since it has been seen that the offset varies according to the gray level.

If, for example the gray level scale is defined by z=19 gamma reference voltages, the code can thus be formed by a series of 22 voltage values, which will each be applied to a corresponding analog voltage generation circuit.

It has been seen that there are other addressing and control modes. For example, the inversion mode can be conducted differently, by varying the counter-electrode bias voltage between a more positive high level and a more negative low level. The application of the invention is then reflected in a setting of the counter-electrode bias voltage offset by temperature.

More generally, a person skilled in the art applies the invention according to the control voltages used in the screen concerned, as a function of the type of pixel (liquid crystal, OLED), of the addressing mode, of a color or non-color display, . . . , by determining the power supply or reference voltage values necessary to the control of the screen, for the different temperature bands.

In a refinement, provision is made to also take account of the light received by the transistors of the screen. In fact, it has been seen that the leakage current of the transistors increases with the intensity of the light received by the transistors. This intensity can vary. In the case of liquid crystals in particular, the light intensity of the backlighting of the light box varies according to whether the ambience is daytime ambience (maximum intensity) or nighttime ambience (minimum intensity). This problem of sensitivity of the transistors to the light relates equally to the control transistors Tp of the pixels, which are directly in the lighting field, and the control transistors Tc of the display control circuit (which receive the light by guidance effect and multiple reflections).

It is then advantageous to adapt the voltage levels, more specifically the VGOFF level, to favor the switching off and therefore minimize the possibilities of current leakage in case of strong light intensity (strong lighting level).

To return to the exemplary implementation in which codes are defined and stored in a programmable circuit 100, there are then established, as for the temperature, brightness bands. The circuit 100 can take the form of a table structure with two inputs: a brightness band and a temperature band, which, for each pair of bands, supplies a corresponding numeric code, as schematically illustrated in FIG. 6.

The light sensor 102 uses, for example, a photodiode implanted in the lighting system of the LCD on the rear face. The measurement is supplied in numeric form by an associated converter 102-N. As for the temperature, a threshold comparator makes it possible to discretize the brightness bands. The temperature and brightness bands selected make it possible to point to a corresponding numeric code in the circuit 100.

Figure 6:
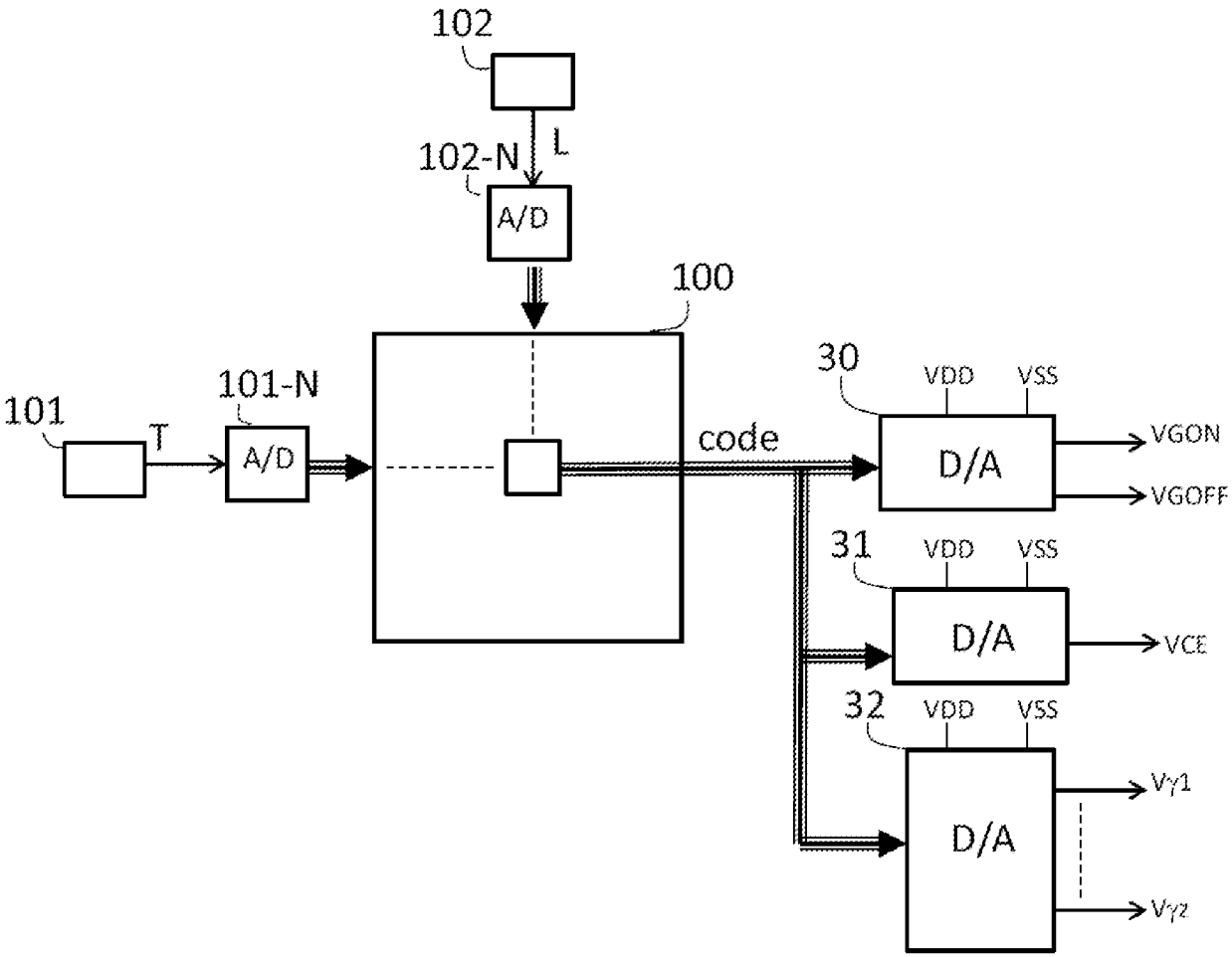
FIG. 6 is a block diagram of adaptation of the different voltages necessary to the addressing and display according to a refinement of the invention applied to a liquid crystal screen.

In FIG. 6, an implementation of the invention has been illustrated whereby the levels of the voltages VGON and VGOFF, but also those of the counter-electrode voltage VCE and of the gamma reference voltages Vγ1-Vγz, are defined. Based on a temperature measurement T, defining a temperature band and a lighting level measurement L defining a brightness band, a corresponding code stored in the circuit 100 is selected. Or else, this code is computed from the measurements T and L by means of computation functions established for the screen concerned. The code contains the various numeric values needed, applied as inputs for circuits 30, 31, 32 for supplying corresponding analog voltages.

As indicated previously, the invention, which has just been described by taking a particular example of a screen, applies more generally to the definition of the power supply and reference voltages necessary to the control of the pixels, as a function of the temperature, and preferably also as a function of the brightness received by the transistors. This principle adapts to other addressing modes or variants, to color or non-color screens, and to liquid crystal screens as well as to OLED screens. Typically, for the latter which use metastable materials sensitive to temperature and light, the same issues of conductivity/leakage current and of gamma correction as a function of the temperature and of the light arise.

The invention claimed is:

1. A display screen comprising an active matrix of pixels arranged in rows and columns, the active matrix comprising a control transistor associated with each pixel, the screen comprising a display control circuit supplying signals driving the control transistors of the pixels, the display screen comprises:

means for supplying a temperature measurement;

a programmable circuit supplying as output a numeric code associated with the temperature measurement; and a circuit supplying a first voltage and a second voltage powering the display control circuit configured to apply, respectively, a switch-on voltage and a switch-off voltage to the control transistors of the pixels, the circuit receiving the numeric code and supplying the first and second voltages as a function of numeric values of the code, the numeric code supplied by the programmable circuit being such that, when the temperature drops, the numeric code defined leads to an increase in the first and the second voltages, and an increase in a difference between the first and the second voltages.

2. The display screen of claim 1, wherein, when the temperature rises, the numeric code defined leads to a decrease in the first and the second voltages, and a decrease in the difference between the first and the second voltages.

3. The display screen of claim 1, comprising a circuit supplying gamma reference voltages defining at least one gray level scale, wherein the numeric code comprises numeric values setting the gamma reference voltages.

4. The display screen of claim 1, which is a liquid crystal or light-emitting diode screen.

5. The display screen of claim 1, of the liquid crystal type, wherein the numeric code comprises a numeric value setting a bias voltage of a counter-electrode of the pixel.

6. The display screen of claim 1, further comprising means for measuring brightness received by the transistors of the display circuit and in that the numeric code is defined for a temperature band and for a brightness band corresponding respectively to the temperature measurement and to the brightness measurement.

7. The display screen of claim 1, in which the programmable circuit is a memory circuit containing a plurality of numeric codes, each code being associated with a given temperature band, the screen comprising means for selecting the numeric code corresponding to the temperature measurement.

8. The display screen of claim 1, further comprising means for measuring brightness received by the transistors of the display circuit and in that the numeric code is defined for a temperature band and for a brightness band corresponding respectively to the temperature measurement and to the brightness measurement and wherein the programmable circuit is a memory circuit containing a plurality of numeric codes, each code being associated with a determined temperature band and brightness band, the screen comprising means for selecting the numeric code corresponding to the temperature and brightness measurements.

* * * * *